US011457514B2

(12) United States Patent
Honma et al.

(10) Patent No.: US 11,457,514 B2
(45) Date of Patent: Sep. 27, 2022

(54) RESIN WINDOW AND METHOD FOR PRODUCING SAME

(71) Applicants: Nobutaka Honma, Toyota (JP); Ai Nishida, Toyota (JP); Kazuhiro Yoshida, Chiryu (JP)

(72) Inventors: Nobutaka Honma, Toyota (JP); Ai Nishida, Toyota (JP); Kazuhiro Yoshida, Chiryu (JP)

(73) Assignees: TOYOTA JIDOSHA KABUSHIKI KAISHA, Toyota (JP); TSUCHIYA CO., LTD., Nagoya (JP)

( * ) Notice: Subject to any disclaimer, the term of this patent is extended or adjusted under 35 U.S.C. 154(b) by 268 days.

(21) Appl. No.: 16/532,685

(22) Filed: Aug. 6, 2019

(65) Prior Publication Data

US 2020/0068665 A1 Feb. 27, 2020

(30) Foreign Application Priority Data

Aug. 23, 2018 (JP) ..... JP2018-156203

(51) Int. Cl.
*H05B 3/86* (2006.01)

(52) U.S. Cl.
CPC ..... *H05B 3/86* (2013.01)

(58) Field of Classification Search
CPC ..... H05B 3/86; H05B 3/84; H05B 2203/013; H05B 2203/017; H05B 2203/002; B60S 1/586; B60J 1/002; B60J 1/003; B61D 25/00; B63B 19/02; B64C 1/1492
See application file for complete search history.

(56) References Cited

U.S. PATENT DOCUMENTS 5,149,351 A * 9/1992 Yaba ..... B32B 17/10036 257/E27.125
5,525,401 A 6/1996 Hirmer
6,024,904 A * 2/2000 Nanri ..... H05B 3/86 264/254
2010/0326722 A1 12/2010 Watazu et al.
2021/0059022 A1* 2/2021 Sadakane ..... B32B 27/288

FOREIGN PATENT DOCUMENTS

JP S54174663 U 12/1979
JP 2010028669 A 2/2010
JP 4669069 B2 4/2011
JP 2015060793 A 3/2015
JP 2016091658 A 5/2016
JP 2016-155287 A 9/2016
JP 2017091888 A 5/2017
JP 2017117785 A 6/2017

* cited by examiner

*Primary Examiner* — Shawntina T Fuqua
(74) *Attorney, Agent, or Firm* — Dickinson Wright, PLLC

(57) ABSTRACT

A resin window capable of preventing breakage of defogger wires, and a method for producing the same. The resin window includes a plate-like resin glass extending from one end side to the other end side and having a curved portion formed thereon in the extending direction of the resin glass, and a film disposed so as to follow the shape of the resin glass and having a defogger wire extending in the extending direction of the resin glass. When seen in the direction normal to the resin glass, the defogger wire has a wave-shaped portion in at least a portion at a position corresponding to the curved portion.

5 Claims, 17 Drawing Sheets

RESIN WINDOW AND METHOD FOR PRODUCING SAME

CROSS REFERENCE TO RELATED APPLICATIONS

The present application claims priority from Japanese patent application JP 2018-156203 filed on Aug. 23, 2018, the content of which is hereby incorporated by reference into this application.

BACKGROUND

Technical Field

The present disclosure relates to a resin window installed in automobiles, aircrafts, vessels, trains, and the like, and a method for producing the same.

Background Art

As resin windows installed in automobiles, aircrafts, vessels, trains, and the like that prevent fog or freezing, those with defogger wires (also referred to as heating wires) on their surfaces are known. JP 2015-60793 A, for example, discloses a resin window including resin glass, a conductive mesh of defogger wires, which extend in the longitudinal and transverse directions, disposed on the resin glass, and a power supply unit coupled to the conductive mesh.

The resin window with such a structure is produced such that the conductive mesh is placed in a mold, into which liquid resin is injected, and the injected resin is then cured. In the injection molding, since the distances between the intersections of the defogger wires of the conductive mesh are variable, the conductive mesh is allowed to follow the shape of a curved portion of the window, so that the defogger wires can be prevented from being stretched. As a result, variations in the thickness of the defogger wires due to being stretched are suppressed, thereby reducing an uneven amount of heat generation that may be caused by the variations in the thickness of the defogger wires.

SUMMARY

However, when such a resin window is produced, a problem may arise in that the defogger wires cannot completely follow the shape of the curved portion of the window, causing breakage of the wires.

The present disclosure has been made in view of the foregoing, and provides a resin window capable of preventing breakage of defogger wires, and a method for producing the same.

The resin window according to the present disclosure includes a plate-like resin glass extending from one end side to the other end side, the plate-like resin glass having a curved portion formed thereon in the extending direction of the resin glass, and a film disposed so as to follow the shape of the resin glass, the film having a defogger wire extending in the extending direction of the resin glass, in which when seen in the direction normal to the resin glass, the defogger wire has a wave-shaped portion in at least a portion at a position corresponding to the curved portion.

In the resin window according to the present disclosure, since the defogger wire has the wave-shaped portion in at least a portion at a position corresponding to the curved portion of the resin glass, the defogger wire is allowed to follow the film being stretched in forming the curved portion, utilizing the wave-shaped portion, so that breakage of the defogger wire can be prevented.

In some embodiments of the resin window according to the present disclosure, the curved portion is formed on each of the one end side and the other end side of the resin glass, and when seen in the direction normal to the resin glass, the defogger wire has a pair of wave-shaped portions and a linear portion that couples the wave-shaped portions, the wave-shaped portions being provided in at least portions at positions respectively corresponding to the curved portions formed on the one end side and the other end side of the resin glass. When the defogger wire is formed as such, the amount of a conductive paste used to form the defogger wire can be reduced as compared to the defogger wire only with the wave-shaped portion. As a result, the cost can be reduced.

In some embodiments of the resin window according to the present disclosure, the wave-shaped portions are attenuated gradually toward the linear portion. This can more effectively prevent breakage of the defogger wire.

In some embodiments of the resin window according to the present disclosure, the plurality of wave-shaped portions that are branched are coupled in parallel to one linear portion, the linear portion and the wave-shaped portions having the same thickness. This can reduce the amount of heat generation on the periphery of the resin window, where heating is less needed, as well as prevent breakage of the defogger wire.

In some embodiments of the resin window according to the present disclosure, the defogger wire includes a plurality of defogger wires arranged in the direction orthogonal to the extending direction of the resin glass, and the phases of the adjacent wave-shaped portions arranged in the direction orthogonal to the extending direction of the resin glass are shifted with respect to each other. This can suppress generation of interference fringes, so that a clear field of view can be secured.

Further, a method for producing the resin window according to the present disclosure includes printing a conductive paste to form a defogger wire on a flat film, stretching the film with the conductive paste printed thereon so as to form a curved portion, and forming a resin glass integrated with the film with the curved portion formed thereon, in which in the printing, a wave-shaped conductive paste is printed on the film so as to extend in a direction in which the film is to be stretched in the stretching.

In the method for producing the resin window according to the present disclosure, since the wave-shaped conductive paste is printed on the film in the printing so as to extend in the direction in which the film is to be stretched in the stretching, the wave-shaped conductive paste is allowed to follow the film being stretched in forming the curved portion in the stretching, so that generation of breakage of the conductive paste can be suppressed. As a result, breakage of the defogger wire to be formed can be prevented.

In some embodiments of the method for producing the resin window according to the present disclosure, the wave-shaped conductive paste is in a triangular wave shape. With such a shape, breakage of the defogger wire can be more effectively prevented.

In some embodiments of the method for producing the resin window according to the present disclosure, when a pair of curved portions are formed on opposite end sides of the film in the stretching, in the printing, the wave-shaped conductive paste is printed on the film at positions where the pair of curved portions are to be formed, and a linear conductive paste is printed on the film at the other position. This can reduce the amount of the conductive paste used as compared to the conductive paste only with the wave-shaped portion. As a result, the cost can be reduced.

In some embodiments of the method for producing the resin window according to the present disclosure, the wave-shaped conductive paste is attenuated gradually toward the linear conductive paste. This can more effectively suppress breakage of the conductive paste.

In some embodiments of the method for producing the resin window according to the present disclosure, in the printing, a plurality of conductive pastes are arranged in the direction orthogonal to the direction in which the film is to be stretched in the stretching, such that the phases of the adjacent conductive pastes are shifted with respect to each other, and are then printed. This can suppress generation of interference fringes, so that a clear field of view can be secured.

According to the present disclosure, breakage of the defogger wire can be prevented.

DETAILED DESCRIPTION

Figure 1:
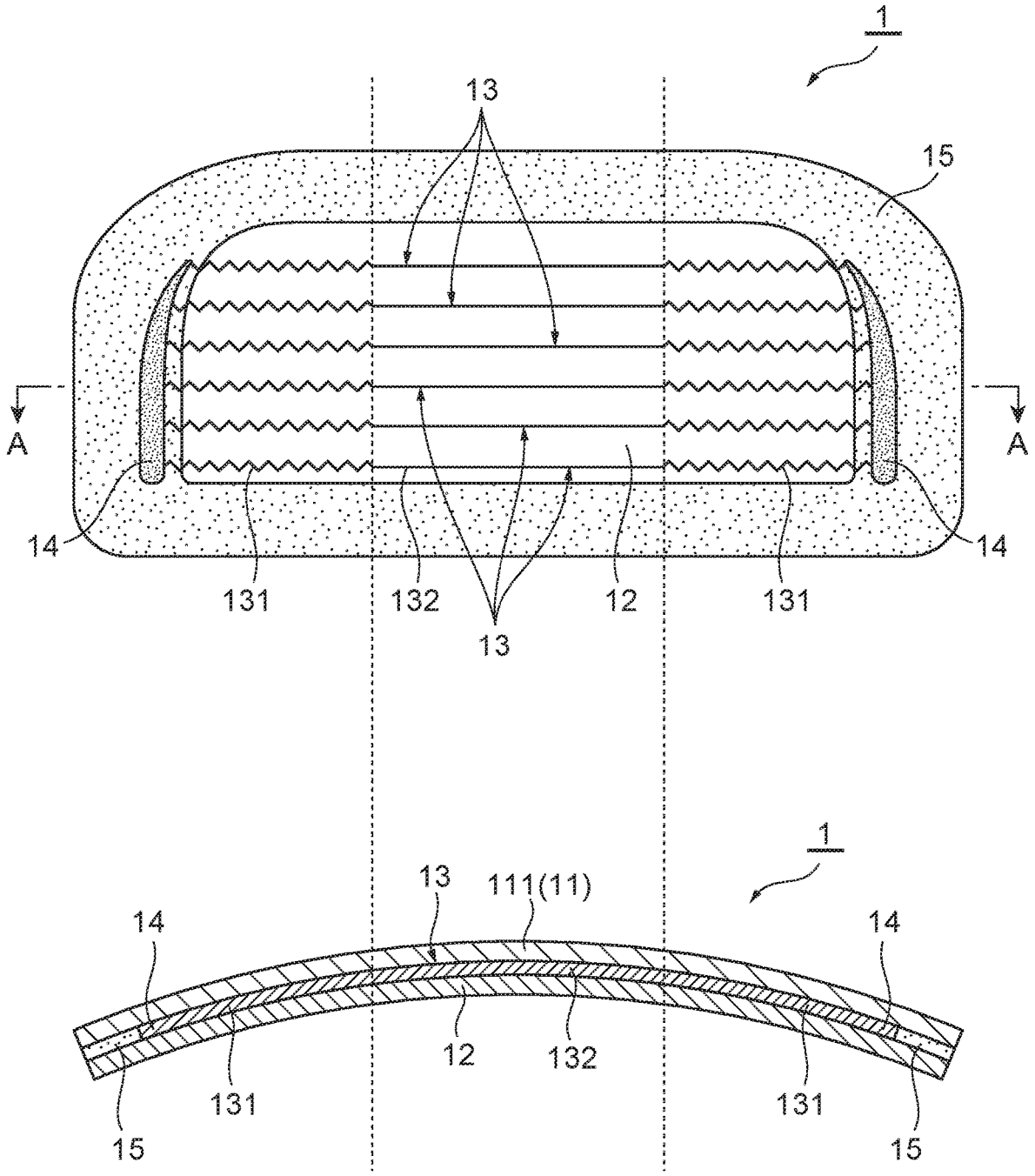
FIG. 1 are front and cross-sectional views of a resin window according to a first embodiment.

Embodiments of a resin window and a method for producing the same according to the present disclosure will be described below with reference to the drawings. Identical elements are denoted by the same reference numerals in the drawings, and their overlapping descriptions will be omitted. Further, to facilitate understanding of the disclosure, the components of the resin window in some drawings may be depicted with greater or smaller thicknesses or sizes as compared to those of the actual product.

Further, the description below illustrates examples in which the resin window according to the present disclosure is used for a rear window of an automobile, but the resin window according to the present disclosure may also be used for the windows of aircrafts, vessels, trains, and the like. Furthermore, the vertical and transverse directions and positions referred to in the description below correspond to those of the resin window when it is actually installed in an automobile.

First Embodiment

FIG. 1 are front and cross-sectional views of a resin window according to a first embodiment. The views on the upper and lower sides of FIG. 1 are a front view of the resin window as seen from the interior of a vehicle and a cross-sectional view taken along line A-A of the view on the upper side, respectively. A resin window 1 of the present embodiment includes arc-shaped plate-like resin glass 11 and a film 12 that is disposed on the inner side of the resin glass 11 (that is, the interior side of a vehicle) and is formed so as to follow the shape of the resin glass 11.

The resin glass 11 extends from one end side (for example, the left side of the vehicle) to the other end side (for example, the right side of the vehicle) and includes a curved portion 111 formed in the extending direction (that is, in the transverse direction of the vehicle). Specifically, the resin glass 11 entirely forms one curved portion 111, which curves outward relative to the interior of the vehicle. In the present embodiment, the curved portion 111 is formed two-dimensionally, but may be formed three-dimensionally, as necessary. The resin glass 11 is made of transparent resin. Examples of the transparent resin include polycarbonate resin, polyvinyl chloride, polyethylene terephthalate, polyethylene naphthalate, polyimide, and acrylic resin.

The film 12 is also made of transparent resin, such as polycarbonate coated silicone and acrylic resin. The film 12 has a plurality of defogger wires 13 (six defogger wires herein). The six defogger wires 13 are arranged equidistantly in the direction orthogonal to the extending direction of the resin glass 11 (that is, the vertical direction of the vehicle). Adjacent wave-shaped portions 131 of the defogger wires arranged in the direction orthogonal to the extending direction of the resin glass 11 have an identical phase.

As illustrated in the front view on the upper side of FIG. 1, when the resin window 1 is seen in the direction normal to the resin glass 11, each defogger wire 13 has the wave-shaped portions 131 in portions at positions corresponding to the left and right sides of the curved portion 111, and a linear portion 132 disposed between the wave-shaped portions 131 on the left and right sides so as to couple them. Further, the length of each of the linear portion 132 and the two wave-shaped portions 131 is nearly a third of the entire length of the defogger wire 13 in the extending direction of the resin glass 11.

Figure 2:
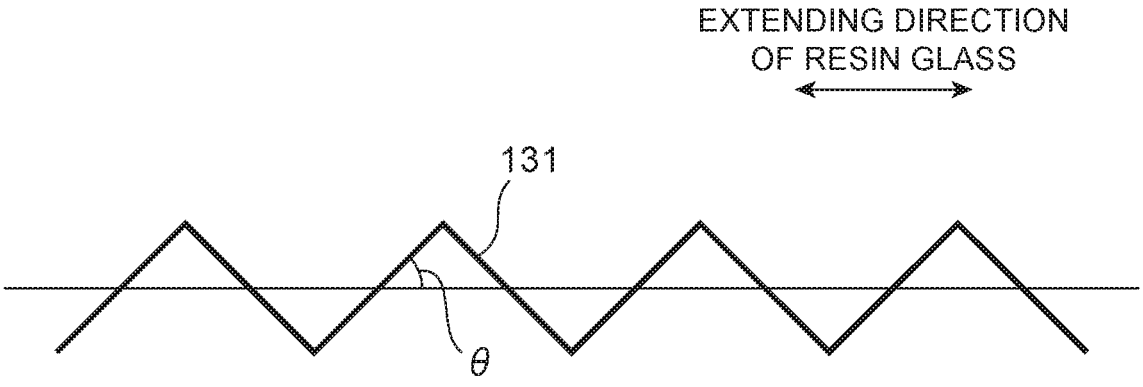
FIG. 2 is an enlarged view of a wave-shaped portion of a defogger wire.

Each wave-shaped portion 131 is in a triangular wave shape. Herein, in some embodiments, in each wave-shaped portion 131, each wave forms an inclination angle θ (see FIG. 2) relative to the extending direction of the resin glass 11 that satisfies $0° < \theta \leq 60°$, in particular, $0° < \theta \leq 45°$. This is because when stretched in the extending direction of the resin glass 11, the wave-shaped portion 131 moves closer to the lateral axis, so that the load is applied to the apexes and vertexes of the triangular wave shape. Further, if the inclination angle θ exceeds 60°, the moving distance of the wave-shaped portion 131 becomes greater, thereby increasing the load applied to the apexes and vertexes of the triangular wave shape, possibly causing breakage of the wire at such apexes and vertexes. To prevent such breakage of the wire, the inclination angle θ of the wave-shaped portion 131 relative to the extending direction of the resin glass 11 should satisfy $0°<\theta\leq 60°$. In particular, when $0°<\theta\leq 45°$ is satisfied, breakage of the wire at the apexes and vertexes of the triangular wave shape can be more effectively prevented.

Further, the resin window 1 of the present embodiment includes a pair of power supply units 14 disposed at opposite ends in the extending direction of the resin glass 11. The power supply units 14 are long and extend in the direction orthogonal to the extending direction of the resin glass 11. Further, the power supply units 14 are coupled to the ends of the wave-shaped portions 131 that are opposite to those on the sides of the linear portion 132.

Furthermore, the resin window 1 is provided with a black frame 15 on its periphery to allow the components inside the vehicle, such as pillars, to be less visible from the outside of the vehicle.

In the resin window 1 with the aforementioned structure, since each defogger wire 13 has the wave-shaped portions 131 in portions at positions corresponding to the left and right sides of the curved portion 111, the defogger wire 13 is allowed to follow the film 12 being stretched in forming the curved portion 111, utilizing the wave-shaped portions 131, so that breakage of the defogger wire 13 can be prevented.

Figure 3A:
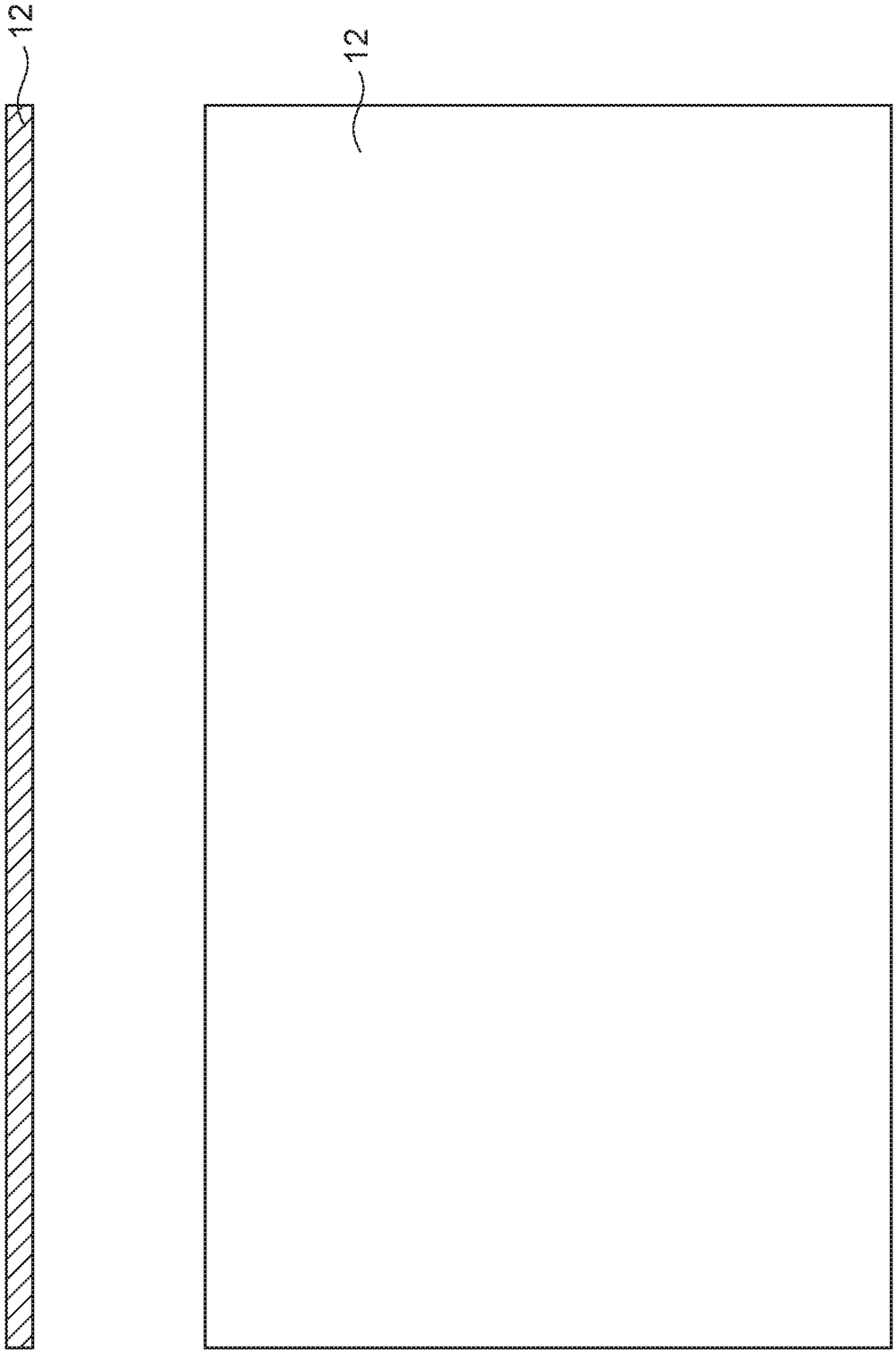
FIG. 3A are process drawings of a method for producing the resin window.
Figure 3B:
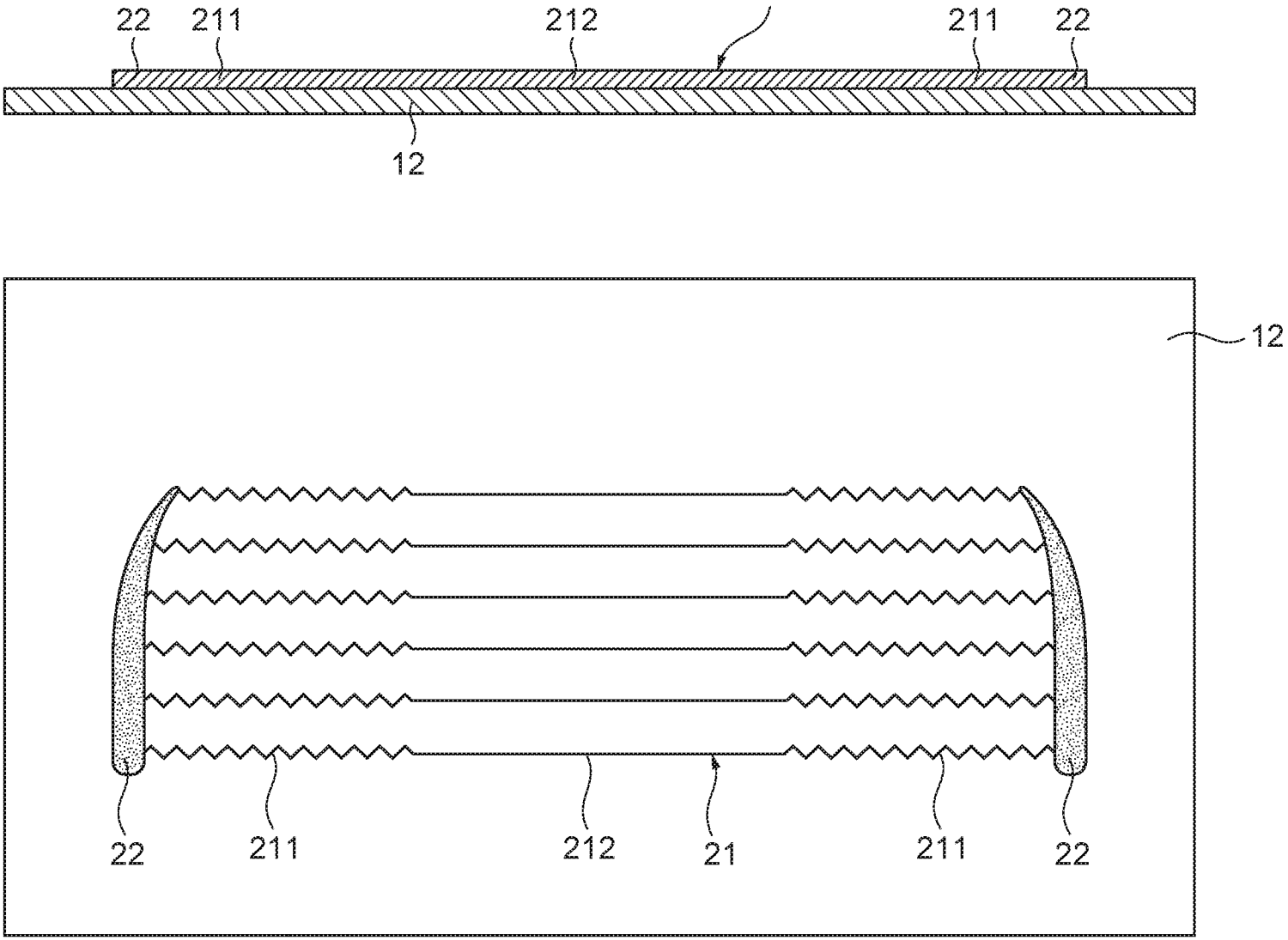
FIG. 3B are process drawings of the method for producing the resin window.
Figure 3C:
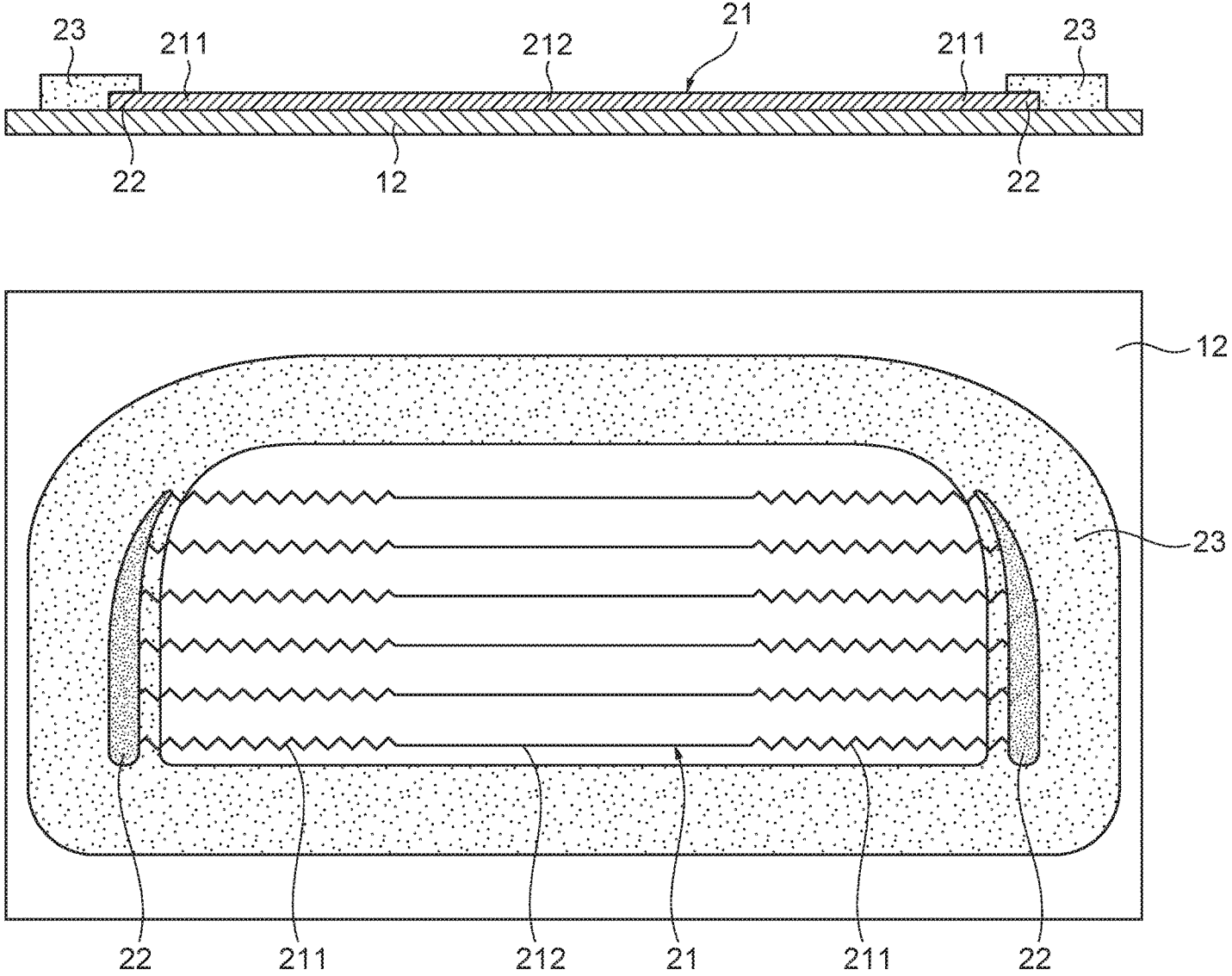
FIG. 3C are process drawings of the method for producing the resin window.
Figure 3D:
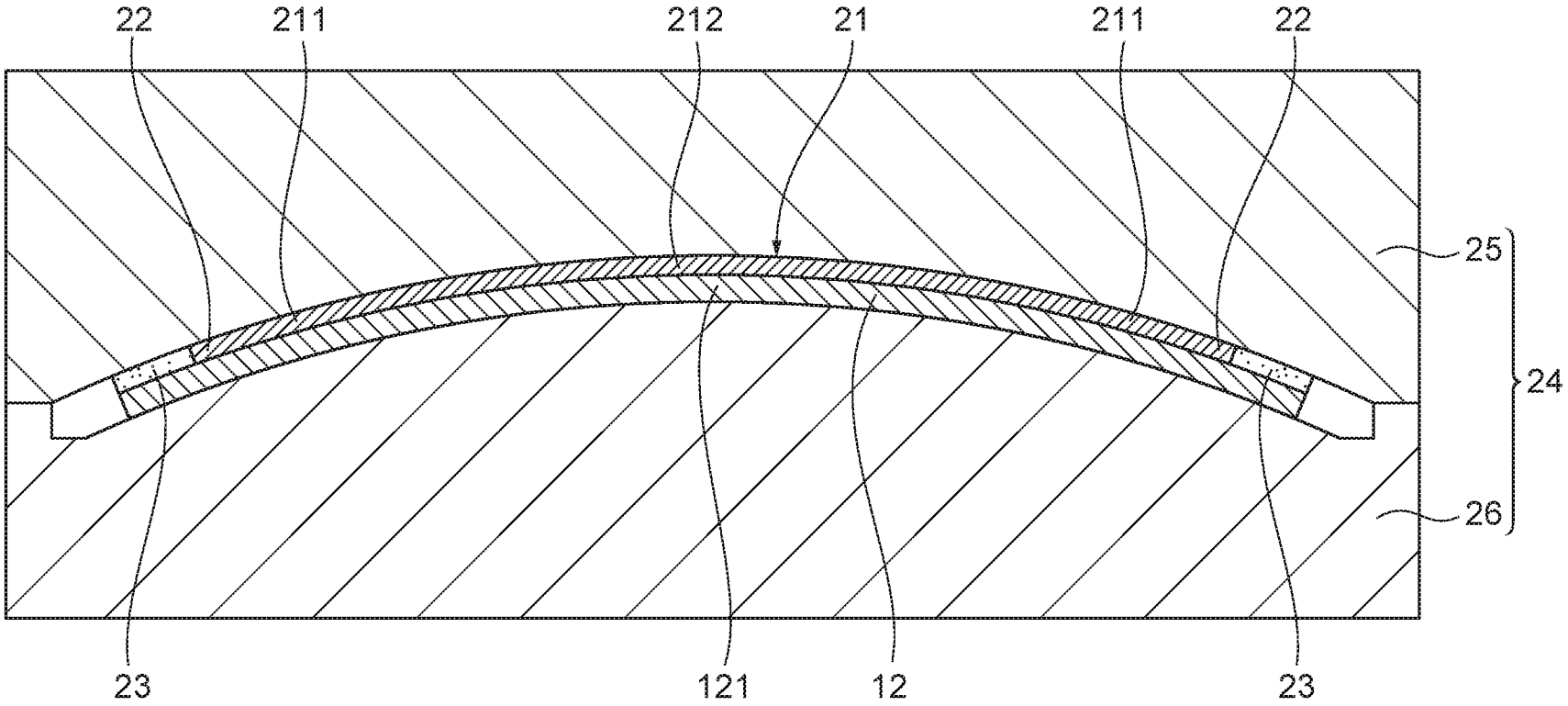
FIG. 3D is a process drawing of the method for producing the resin window.

A method for producing the resin window 1 will be described below with reference to FIG. 3A to FIG. 3E. It should be noted that the views on the upper sides of FIG. 3A to FIG. 3C are cross-sectional views and those on the lower sides are plan views of the resin window 1. The method for producing the resin window 1 according to the present embodiment mainly includes a first step of printing a conductive paste to form the defogger wire on a flat film, a second step of stretching the film with the conductive paste printed thereon so as to form a curved portion, and a third step of forming resin glass integrated with the film with the curved portion formed thereon.

In the first step, the film 12 in a rectangular flat shape is prepared first (see FIG. 3A). Then, a conductive paste 21 to form the defogger wire 13 is printed on the film 12 at a predetermined position. At this time, the conductive paste 21 with wave-shaped conductive pastes 211 and a linear conductive paste 212 is printed so as to extend in the direction in which the film 12 is to be stretched in the second step (see FIG. 3B). It should be noted that the wave-shaped conductive paste 211 herein is in a triangular wave shape.

Specifically, when the film 12 is stretched in the transverse direction in the second step, for example, the conductive paste 21 with the wave-shaped conductive pastes 211 and the linear conductive paste 212 is printed on the film 12 so as to extend in the transverse direction of the film 12. For example, the wave-shaped conductive pastes 211 are printed on the opposite sides in the transverse direction of the film 12 and the linear conductive paste 212 is printed between the wave-shaped conductive pastes 211 on the film 12. The wave-shaped conductive pastes 211 and linear conductive paste 212 respectively form the aforementioned wave-shaped portions 131 and linear portion 132 of the defogger wire 13.

Further, in some embodiments, since six defogger wires 13 are to be formed as described above, in the first step, six conductive pastes 21 are arranged in the direction orthogonal to the direction in which the film 12 is to be stretched in the second step and are then printed. At this time, the six conductive pastes 21 may be printed one by one or all together. After printing the six conductive pastes 21, conductive pastes 22 to form the power supply units 14 are printed at predetermined positions on the opposite sides in the transverse direction of the film 12. It should be noted that the conductive pastes 22 to form the power supply units 14 herein may be printed together with the conductive pastes 21.

Then, a black paste 23 to form the black frame 15 is printed on the periphery of the conductive pastes 21 and 22 that have been printed so as to surround them (see FIG. 3C).

In the second step, an upper die 25 and a lower die 26 of a mold 24 are opened so that the film 12 with the conductive pastes 21 and 22 and black paste 23 printed thereon is placed between the dies, and the film 12 is heated with an infrared heater (not shown) so as to be softened. Then, the upper die 25 and the lower die 26 are clamped so as to stretch the film 12 through a shaping process to form a curved portion 121 (see FIG. 3D). Further, the wave-shaped conductive pastes 211 are stretched so as to follow the film 12 being stretched in forming the curved portion 121.

Figure 3E:
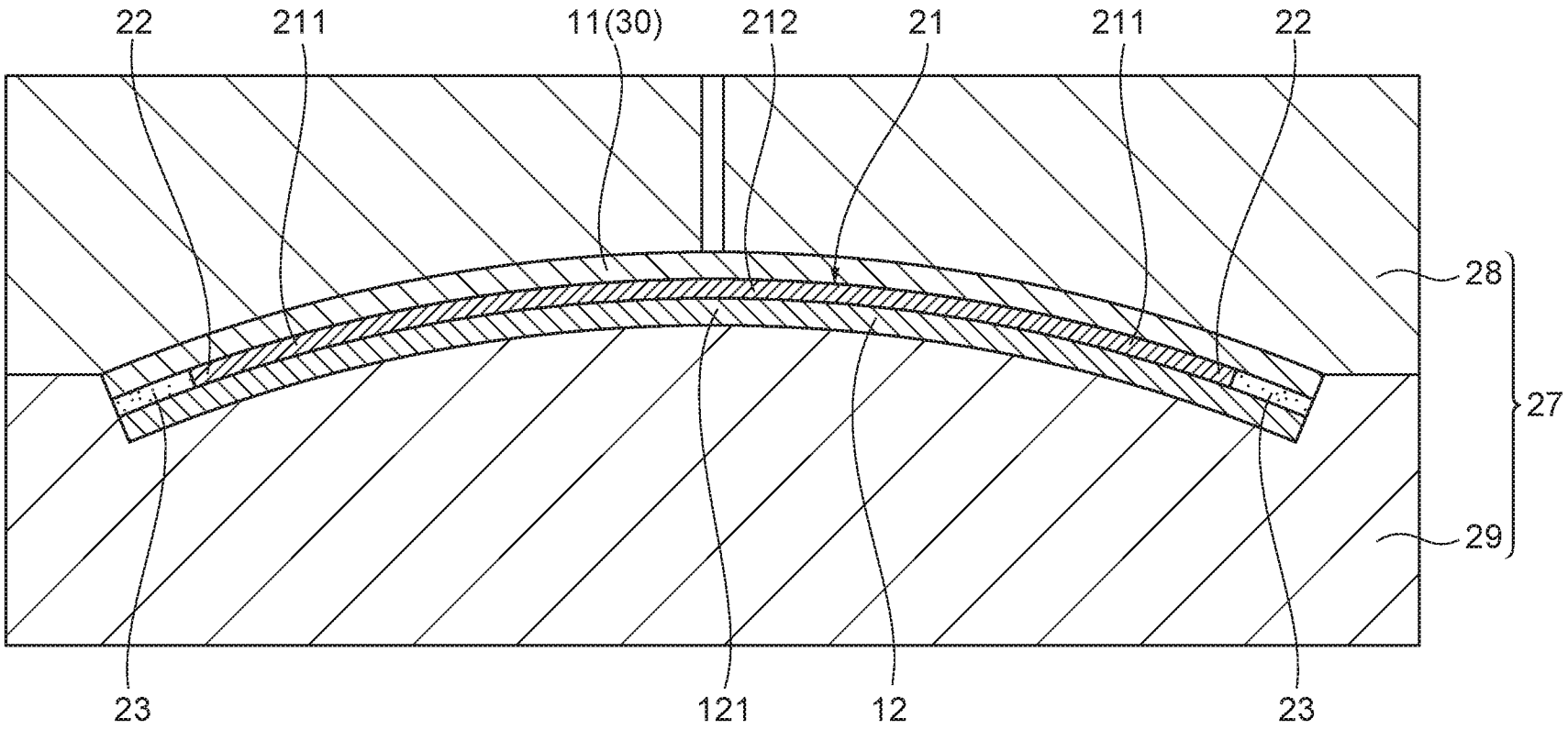
FIG. 3E is a process drawing of the method for producing the resin window.

In the third step, an upper die 28 and a lower die 29 of an injection mold 27 are opened so that the film 12 with the curved portion 121 formed thereon is placed between the dies, and are then clamped so that transparent resin (for example, polycarbonate) 30 is injection-molded into the injection mold 27 to form the resin glass 11 with the curved portion 111 that follows the shape of the film 12 (see FIG. 3E). Then, the formed resin glass is removed from the injection mold 27 and a hard coating for damage prevention is applied to the surface of the resin glass on the exterior side of the vehicle, and the production of the resin window 1 is then completed.

In the method for producing the resin window according to the present embodiment, since the wave-shaped conductive pastes 211 are printed on the film 12 in the first step so as to extend in the direction in which the film 12 is to be stretched in the second step, the wave-shaped conductive pastes 211 are allowed to follow the film 12 being stretched in forming the curved portion 121 in the second step, so that generation of breakage of the conductive paste 21 can be suppressed. As a result, breakage of the defogger wires 13 to be formed can be prevented. In addition, since the generation of the breakage of the conductive paste 21 is suppressed, an increase in the resistance of the defogger wires 13 to be formed is prevented, so that the heat generating performance of the defogger wires 13 can be secured.

Figure 4:
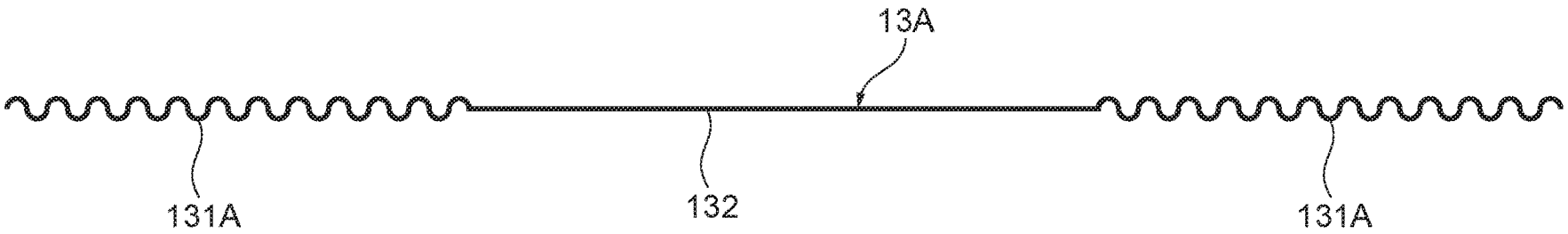
FIG. 4 is a schematic view of a variation of the defogger wire.

It should be noted that the wave-shaped portions of the defogger wire 13 of the present embodiment may be in various shapes as variations in addition to the aforementioned triangular wave shape. For example, wave-shaped portions 131A of a defogger wire 13A illustrated as a variation in FIG. 4 are each in a sine wave shape. More specifically, the wave-shaped portions 131A are each formed with semicircles alternately projecting upward and downward in the extending direction of the resin glass 11. The resin window with such a defogger wire 13A has the same operational advantages as those of the aforementioned embodiment.

Figure 5:
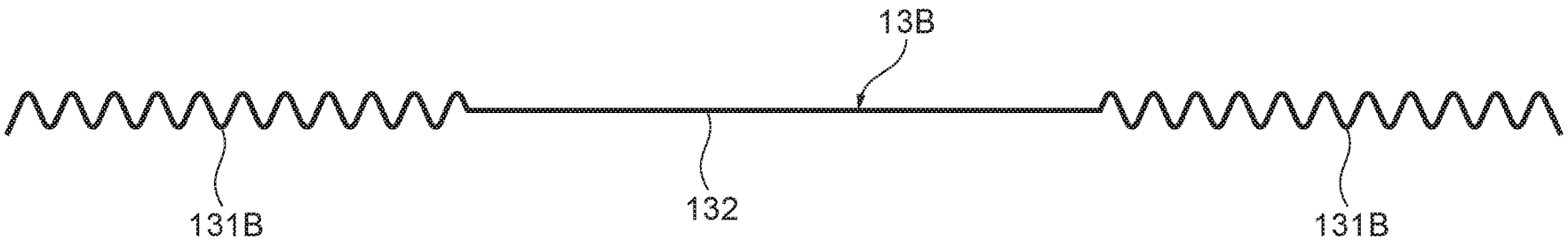
FIG. 5 is a schematic view of a variation of the defogger wire.

Further, wave-shaped portions 131B of a defogger wire 13B illustrated as another variation in FIG. 5 are each in a triangular wave shape with round apexes and vertexes. The resin window with such a defogger wire 13B has the same operational advantages as those of the aforementioned embodiment.

Figure 6:
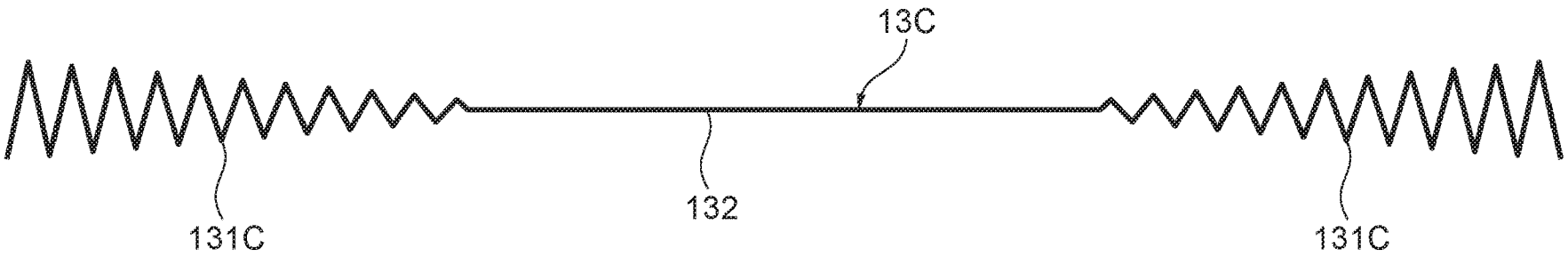
FIG. 6 is a schematic view of a variation of the defogger wire.

Furthermore, wave-shaped portions 131C of a defogger wire 13C illustrated as yet another variation in FIG. 6 are each in a triangular wave shape and are attenuated gradually toward the linear portion 132. The resin window with such a defogger wire 13C has the same operational advantages as those of the aforementioned embodiment. In addition, as the wave-shaped portions 131C are attenuated gradually toward the linear portion 132, breakage of the defogger wire 13C can be more effectively prevented.

Figure 7:
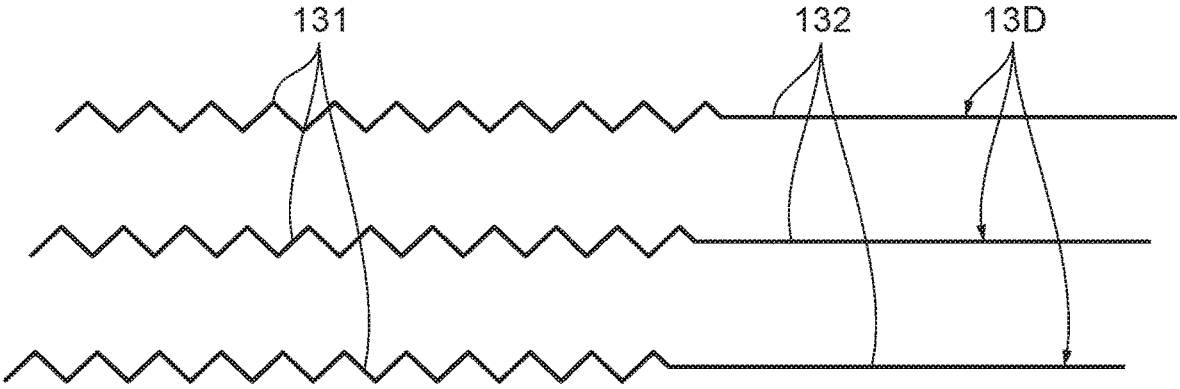
FIG. 7 is a schematic view of a variation of the defogger wire.

In addition, in another variation illustrated in FIG. 7, the phases of the adjacent wave-shaped portions 131 arranged in the direction orthogonal to the extending direction of the resin glass 11 are shifted by 20° or 30°, for example. The resin window with defogger wires 13D formed as such has the same operational advantages as those of the aforementioned embodiment. In addition, as the phases of the adjacent wave-shaped portions 131 are shifted with respect to each other, generation of interference fringes can be suppressed, so that a clear field of view can be secured. When the resin window with such defogger wires 13D is produced, it is acceptable as long as, in the first step, a plurality of conductive pastes 21 are arranged in the direction orthogonal to the direction in which the film 12 is to be stretched in the second step, such that the phases of the adjacent wave-shaped conductive pastes 211 are shifted with respect to each other, and the plurality of conductive pastes 21 are then printed.

Figure 8:
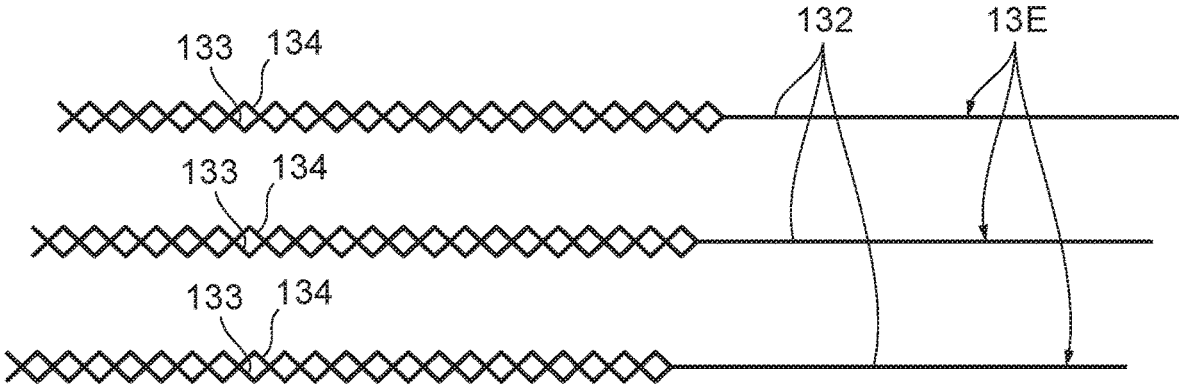
FIG. 8 is a schematic view of a variation of the defogger wire.

Moreover, in yet another variation illustrated in FIG. 8, a plurality of wave-shaped portions 133 and 134 (two wave-shaped portions herein) that are branched are coupled in parallel to one linear portion 132, the linear portion 132 and the wave-shaped portions 133 and 134 having the same thickness. Specifically, the wave-shaped portions 133 and 134 each have a triangular wave shape, and are arranged with their phases shifted by 180°, for example. The wave-shaped portions 133 and 134 are each coupled to the linear portion 132 at one end thereof, and to the power supply unit 14 at the other end thereof. Herein, in some embodiments, the phases of the adjacent wave-shaped portions 133 or those of the adjacent wave-shaped portions 134 that are arranged in the direction orthogonal to the extending direction of the resin glass 11 are further shifted with respect to each other. The phases may be shifted by 20° or 30°, for example.

The resin window with defogger wires 13E formed as such further has the following operational advantages in addition to the same operational advantages as those of the aforementioned embodiment. Specifically, since the two branched wave-shaped portions 133 and 134 are coupled in parallel to one linear portion 132, the resistance is reduced, so that the amount of heat generation on the periphery of the resin window 1, where heating is less needed, can be reduced. In addition, since the linear portion 132 and the wave-shaped portions 133 and 134 have the same thickness, only one type of a conductive paste is needed for forming them. That is, a conductive paste having the same thickness as that of the linear portion 132 can be printed as existing equipment can also be used for the wave-shaped portions 133 and 134.

Second Embodiment

Figure 9:
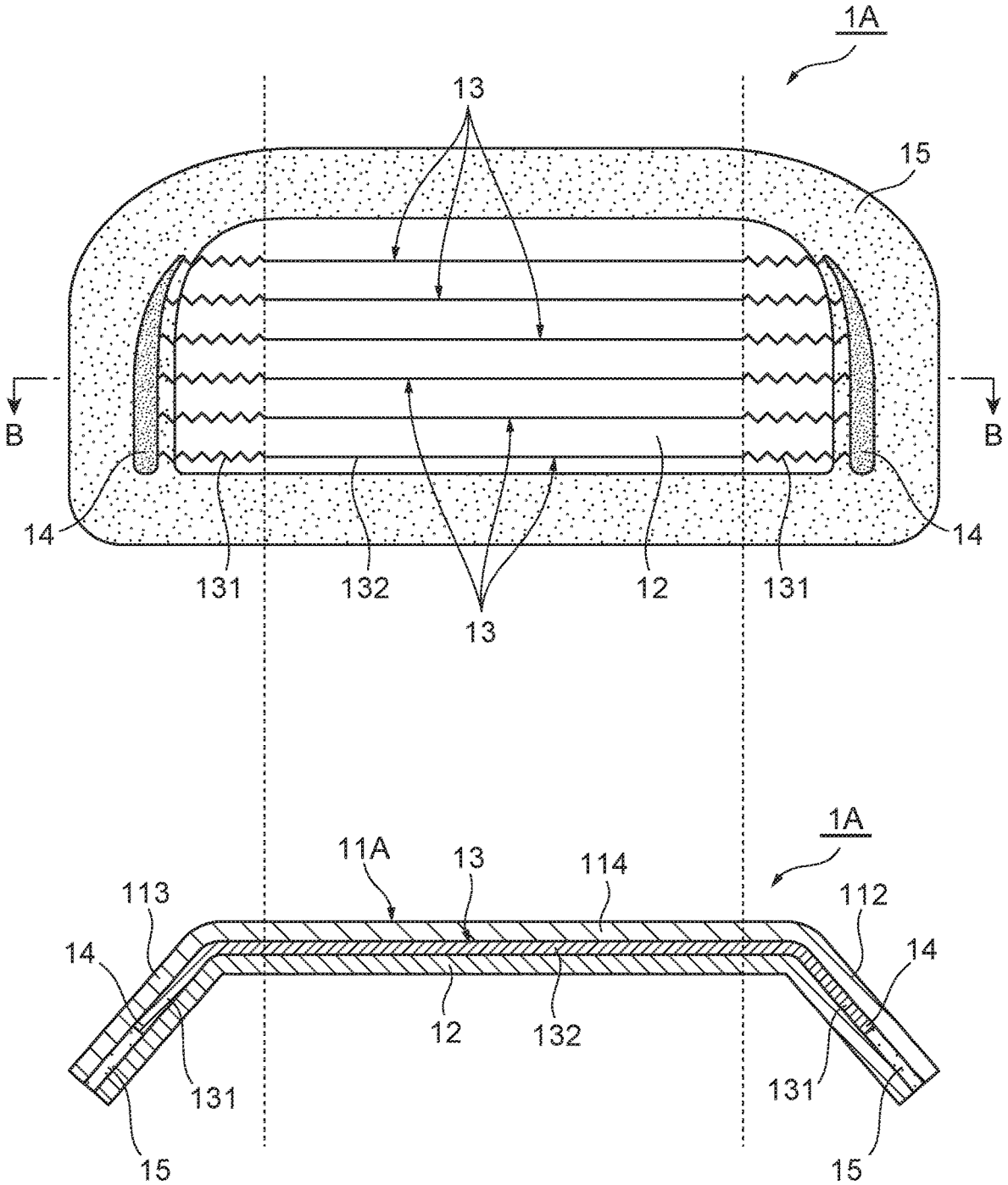
FIG. 9 are front and cross-sectional views of a resin window according to a second embodiment.

FIG. 9 are front and cross-sectional views of a resin window according to a second embodiment. The view on the upper side of FIG. 9 is a front view of the resin window as seen from the interior of a vehicle, and the view on the lower side is a cross-sectional view taken along line B-B of the view on the upper side. A resin window 1A of the present embodiment is different in shape from the aforementioned first embodiment. Therefore, only the differences between the present embodiment and the first embodiment will be described below.

Specifically, resin glass 11A of the resin window 1A includes curved portions 112 and 113 that are respectively formed on the left and right sides in the extending direction of the resin glass 11A, and a planar portion 114 disposed between the curved portions 112 and 113. In the extending direction of the resin glass 11A, the planar portion 114 is formed larger than each of the curved portions 112 and 113. Meanwhile, the film 12 is disposed so as to follow the shapes of the curved portion 112, planar portion 114, and curved portion 113 of the resin glass 11A.

Further, when seen in the direction normal to the resin glass 11A, the defogger wire 13 has the wave-shaped portion 131 at a position corresponding to the entire curved portion 112 and a portion of the planar portion 114 of the resin glass 11A, the wave-shaped portion 131 at a position corresponding to the entire curved portion 113 and a portion of the planar portion 114, and the linear portion 132 that couples these wave-shaped portions 131.

The resin window 1A according to the present embodiment has the same operational advantages as those of the aforementioned first embodiment. In addition, since the defogger wire 13 has the wave-shaped portions 131 and linear portion 132, the amount of a conductive paste used to form the defogger wire 13 can be reduced as compared to the defogger wire only with the wave-shaped portion. As a result, the cost can be reduced.

It should be noted that the method for producing the resin window 1A is different from the aforementioned first embodiment in the first step. Specifically, in the first step according to the method for producing the resin window 1A, the wave-shaped conductive pastes 211 are printed on the film 12 at positions where curved portions are to be formed that correspond to the curved portions 112 and 113 and portions of the planar portion 114 of the resin glass 11A, and the linear conductive paste 212 is printed on the film 12 at the other position.

Third Embodiment

Figure 10:
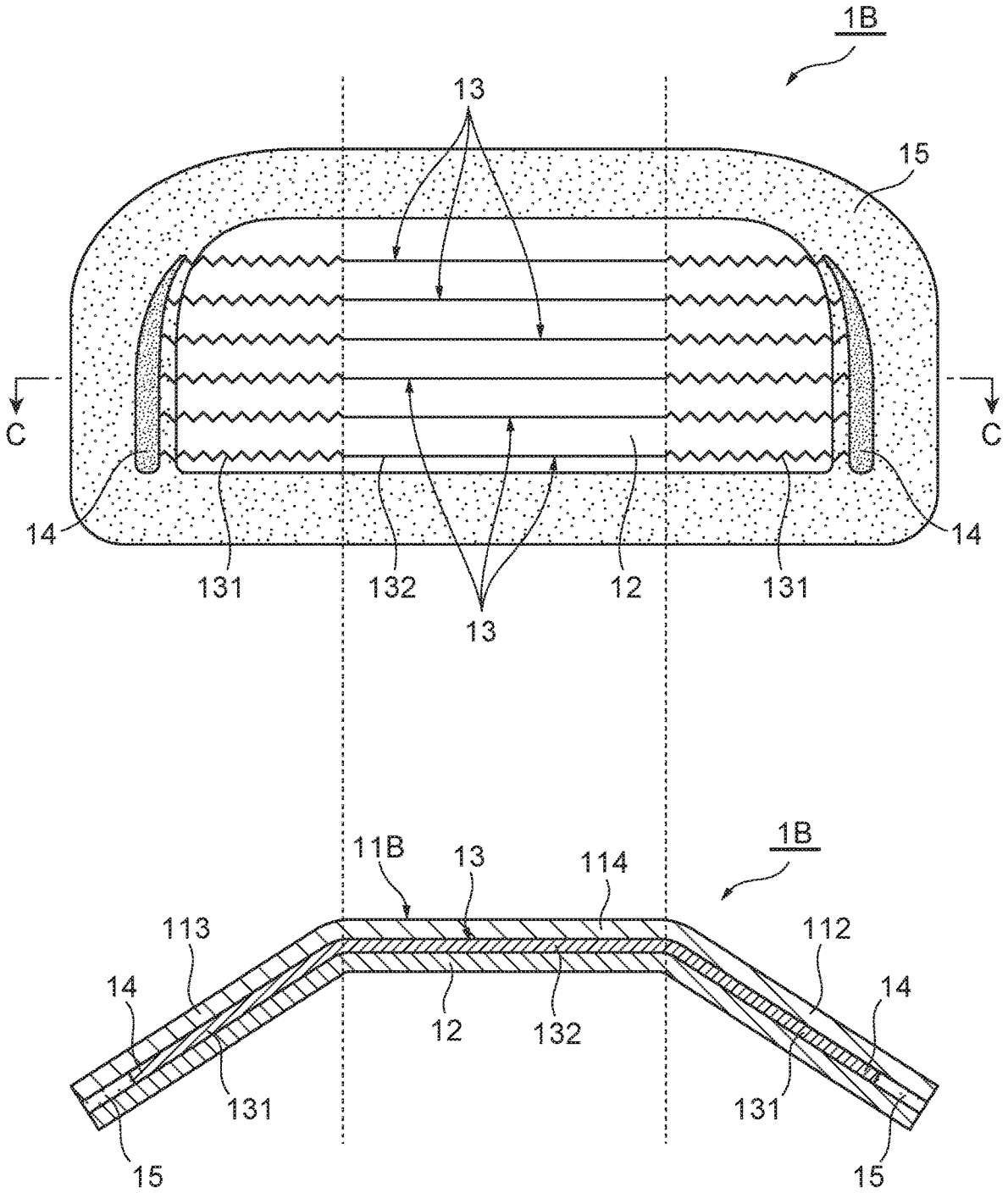
FIG. 10 are front and cross-sectional views of a resin window according to a third embodiment.

FIG. 10 are front and cross-sectional views of a resin window according to a third embodiment. The view on the upper side of FIG. 10 is a front view of the resin window as seen from the interior of a vehicle, and the view on the lower side is a cross-sectional view taken along line C-C of the view on the upper side. A resin window 1B of the present embodiment is different in shape from the aforementioned second embodiment. Therefore, only the differences between the third embodiment and the second embodiment will be described below.

Specifically, similarly to the resin glass 11A of the second embodiment, resin glass 11B of the resin window 1B includes the curved portions 112 and 113 that are respectively formed on the left and right sides in the extending direction of the resin glass 11B, and the planar portion 114 disposed between the curved portions 112 and 113. Further, the length of each of the curved portion 112, planar portion 114, and curved portion 113 is nearly a third of the entire length of the resin glass 11B in the extending direction of the resin glass 11B.

When seen in the direction normal to the resin glass 11B, the defogger wire 13 has the wave-shaped portion 131 at a position corresponding to the entire curved portion 112 of the resin glass 11B, the wave-shaped portion 131 at a position corresponding to the entire curved portion 113, and the linear portion 132 provided at a position corresponding to the entire planar portion 114. Further, the length of each of the linear portion 132 and the two wave-shaped portions 131 is nearly a third of the entire length of the defogger wire 13 in the extending direction of the resin glass 11B.

The resin window 1B according to the present embodiment has the same operational advantages as those of the aforementioned first embodiment. Further, the method for producing the resin window 1B is the same as that of the aforementioned second embodiment.

Fourth Embodiment

Figure 11:
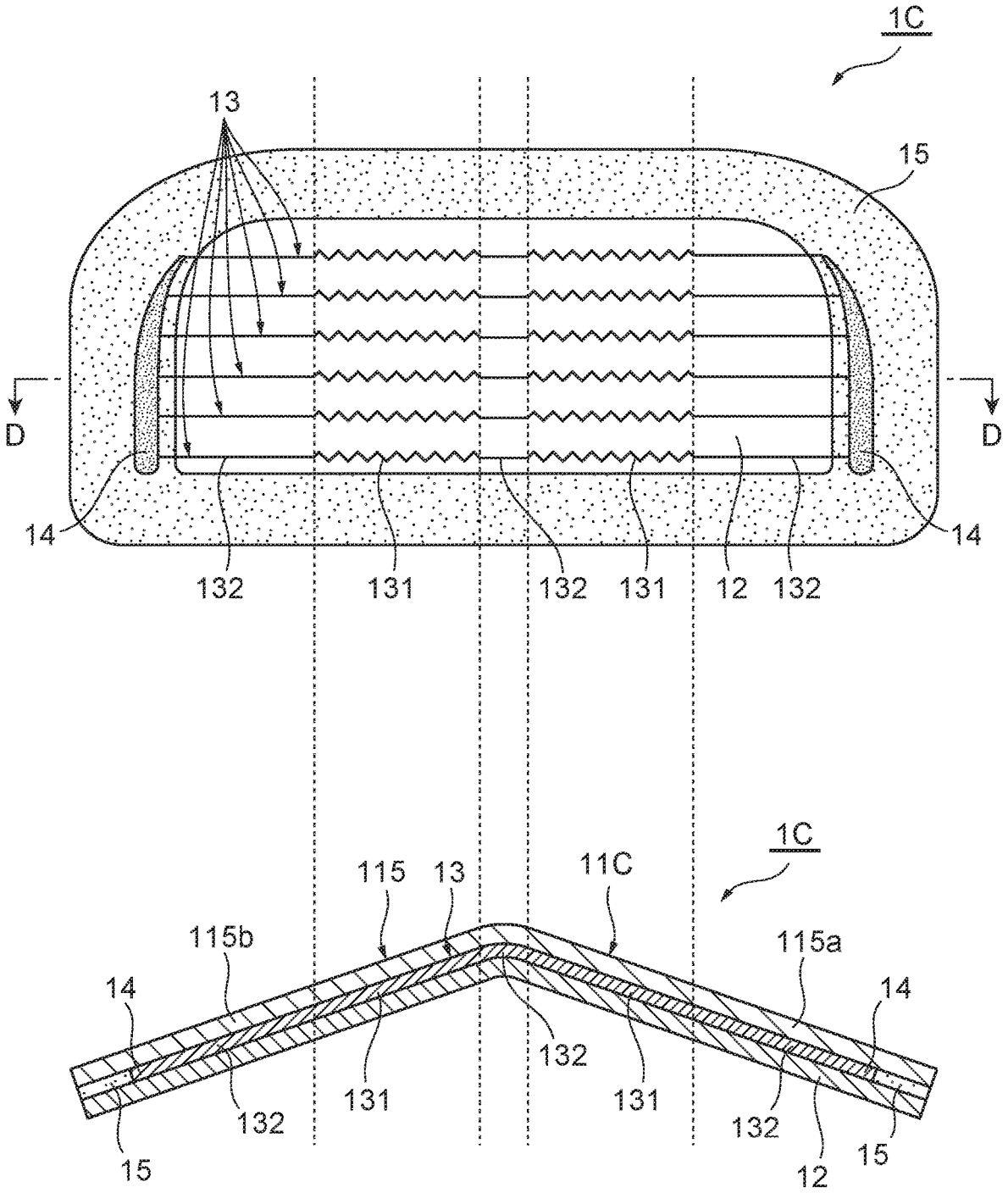
FIG. 11 are front and cross-sectional views of a resin window according to a fourth embodiment.

FIG. 11 are front and cross-sectional views of a resin window according to a fourth embodiment. The view on the upper side of FIG. 11 is a front view of the resin window as seen from the interior of a vehicle, and the view on the lower side is a cross-sectional view taken along line D-D of the view on the upper side. A resin window 1C of the present embodiment is different in shape from the aforementioned first embodiment. Therefore, only the differences between the fourth embodiment and the first embodiment will be described below.

Specifically, a resin glass 11C is formed so as to have a curved portion 115 in an inverted V shape. A left side ridgeline 115*a* and a right side ridgeline 115*b* that form the curved portion 115 are symmetrical about the center of the curved portion 115. Meanwhile, the film 12 is disposed so as to follow the shape of the resin glass 11C.

Further, when seen in the direction normal to the resin glass 11C, the defogger wire 13 has the wave-shaped portion 131 in a portion at a position corresponding to the left side ridgeline 115*a*, the wave-shaped portion 131 in a portion at a position corresponding to the right side ridgeline 115*b*, and the linear portion 132 that couples the wave-shaped portions 131. As illustrated in the cross-sectional view on the lower side of FIG. 11, the wave-shaped portions 131 are each provided so as not to entirely correspond to the left side ridgeline 115*a* or right side ridgeline 115*b*, but are each provided in a portion closer to the apex of the inverted V shape of the defogger wire 13 at a position corresponding to the ridgeline 115*a* or 115*b*.

Furthermore, as illustrated in the cross-sectional view on the lower side of FIG. 11, the wave-shaped portion 131 provided in the portion at the position corresponding to the left side ridgeline 115*a* is coupled, via the linear portion 132, to the power supply unit 14 provided on the left side. Similarly, the wave-shaped portion 131 provided in the portion at the position corresponding to the right side ridgeline 115*b* is coupled, via the linear portion 132, to the power supply unit 14 provided on the right side.

The resin window 1C according to the present embodiment has the same operational advantages as those of the aforementioned first embodiment. Further, the method for producing the resin window 1C is the same as that of the aforementioned first embodiment.

Fifth Embodiment

Figure 12:
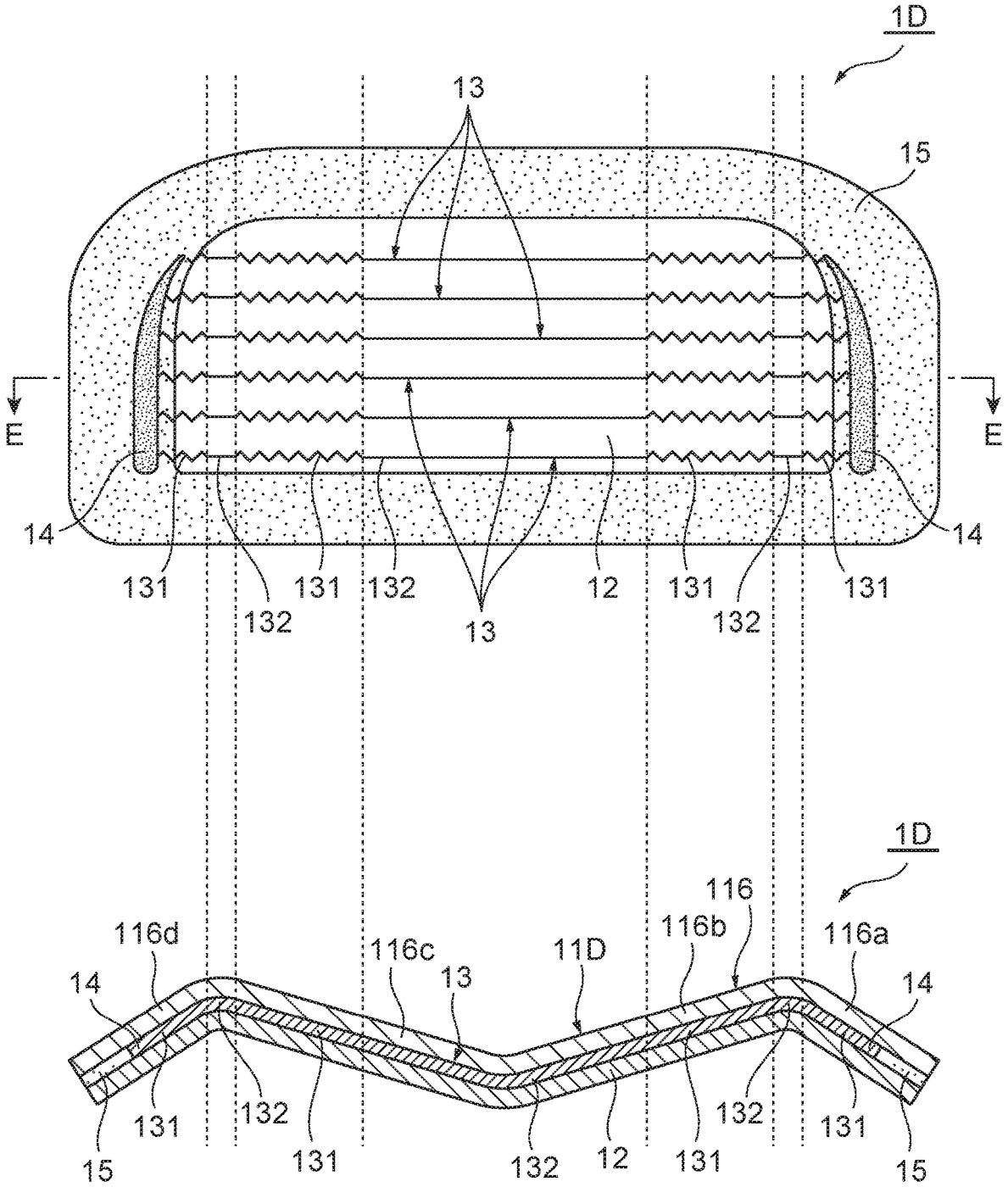
FIG. 12 are front and cross-sectional views of a resin window according to a fifth embodiment.

FIG. 12 are front and cross-sectional views of a resin window according to a fifth embodiment. The view on the upper side of FIG. 12 is a front view of the resin window as seen from the interior of a vehicle, and the view on the lower side is a cross-sectional view taken along line E-E of the view on the upper side. A resin window 1D of the present embodiment is different in shape from the aforementioned first embodiment. Therefore, only the differences between the present embodiment and the first embodiment will be described below.

Specifically, a resin glass 1D is formed so as to have a curved portion 116 in a substantially M shape. More specifically, four ridgelines (or a first ridgeline 116*a*, second ridgeline 116*b*, third ridgeline 116*c*, and fourth ridgeline 116*d*) are sequentially disposed from the left side to the right side, such that they are coupled so as to form the M shape. Therefore, the adjacent first ridgeline 116*a* and second ridgeline 116*b* form one apex of the M shape, the adjacent second ridgeline 116*b* and third ridgeline 116*c* form the vertex of the M shape, and the adjacent third ridgeline 116*c* and fourth ridgeline 116*d* form the other apex of the M shape. Meanwhile, the film 12 is disposed so as to follow the shape of the resin glass 11D.

Further, when seen in the direction normal to the resin glass 11D, the defogger wire 13 has the wave-shaped portions 131 in portions at positions corresponding to the first ridgeline 116*a*, second ridgeline 116*b*, third ridgeline 116*c*, and fourth ridgeline 116*d*, and the linear portions 132 that couple the adjacent wave-shaped portions 131. As illustrated in the cross-sectional view on the lower side of FIG. 12, the wave-shaped portions 131 are provided so as not to entirely correspond to the respective ridge lines, but are provided in portions closer to the apexes of the M-shaped curved portion 116.

The resin window 1D according to the present embodiment has the same operational advantages as those of the aforementioned first embodiment. Further, the method for producing the resin window 1D is the same as that of the aforementioned first embodiment.

The present disclosure will be described below by way of examples, but is not limited to the scope of the examples.

Examples 1 to 3

Figure 13:
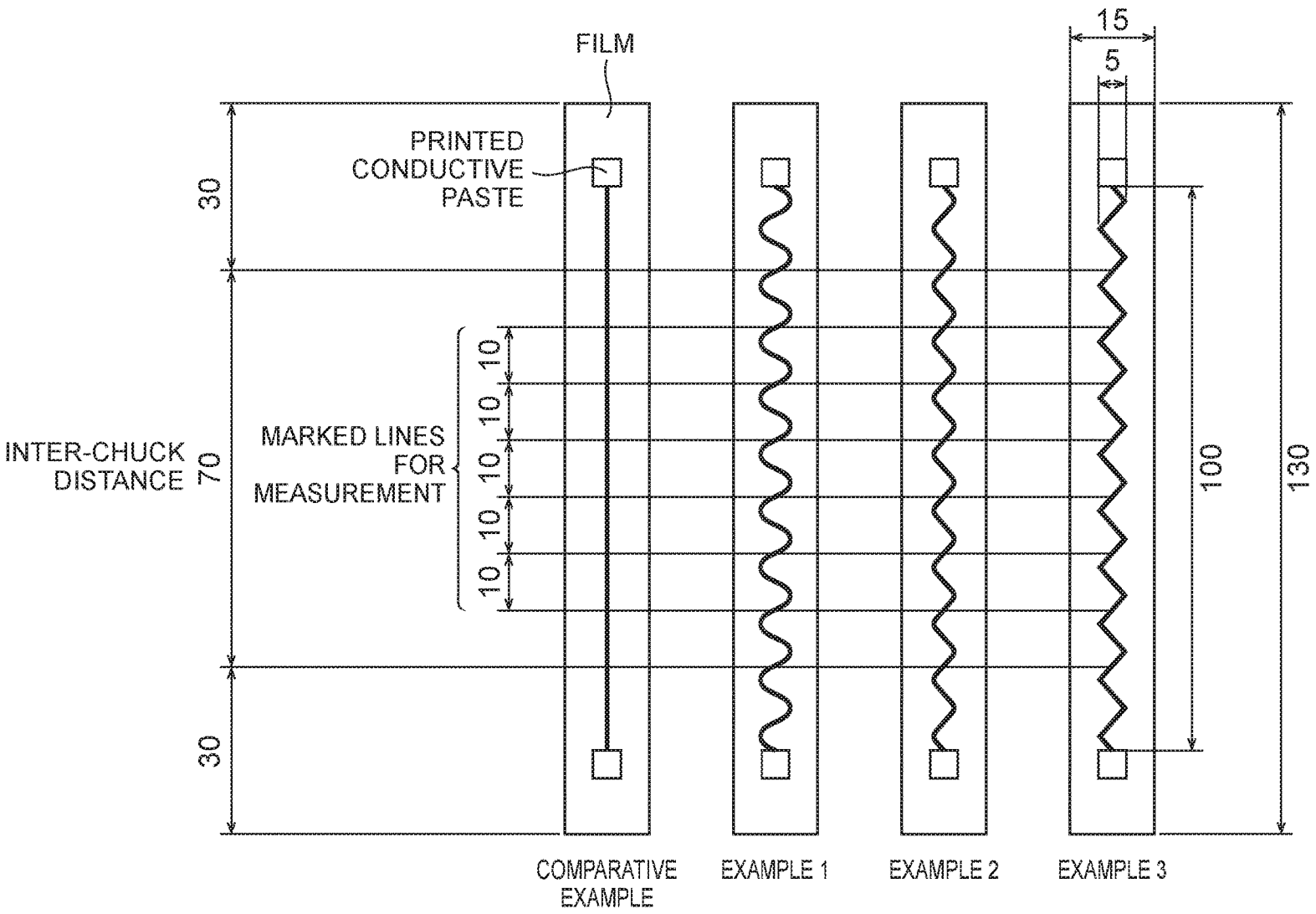
FIG. 13 illustrates samples of Examples and Comparative Example.

In Examples 1 to 3, samples that satisfy the conditions (unit of size: mm) shown in FIG. 13 were prepared. Each sample is a rectangular film with printed thereon a wave-shaped conductive paste (having a width of 0.3 mm) to form a defogger wire. A sine wave-shaped conductive paste, triangular wave-shaped conductive paste with the apexes rounded, and triangular wave-shaped conductive paste with the apexes not rounded were used for Examples 1, 2, and 3, respectively.

Then, the prepared samples were placed in a constant-temperature bath at 160° C. After being left in the bath for about five minutes, the samples were taken out of the bath for undergoing a stretch test at a constant speed (a stretching speed of 1,000 mm/min) with an inter-chuck distance of 70 mm in the longitudinal direction to check if breakage of the defogger wires occurs. Further, after the samples were left for about five minutes in the constant-temperature bath at 160° C. and for another 60 minutes at room temperature, the sizes and resistance values of portions of the samples between marked lines for measurement shown in FIG. 13 were measured, and the resistance values when the samples were stretched at various stretching rates were further measured.

Comparative Example

Further, a sample with a linear conductive paste that satisfies the conditions shown in FIG. 13 was prepared for comparison, and underwent the same test as that of the aforementioned examples.

TABLE 1

| | Stretching Rate (Unit: times) | | | | |
|---|---|---|---|---|---|
| | 1.18 | 1.23 | 1.28 | 1.3 | 1.33 |
| Comparative Example | ○ | x | x | x | x |
| Example 1 | ○ | ○ | ○ | ○ | x |
| Example 2 | ○ | ○ | ○ | ○ | ○ |
| Example 3 | ○ | ○ | ○ | ○ | ○ |

Table 1 shows the results of the breakage check conducted at various stretching rates. Crosses in the table indicate that the wires broke, while circles indicate that the wires conducted electricity (that is, no breakage occurred). As seen from Table 1, in Comparative Example, the wire broke when stretched at a stretching rate of 1.23 times. Meanwhile, it was confirmed that in Example 1, the wire conducted electricity when stretched at a stretching rate of 1.3 times, and in Examples 2 and 3, the wires conducted electricity when stretched at a stretching rate of 1.33 times. These results proved that the wave-shaped conductive paste is more stretchable than the linear conductive paste and is capable of preventing breakage of the defogger wire.

TABLE 2

| | Resistance value measured when stretched at each rate (Unit: Ω) | | |
|---|---|---|---|
| | 1.2 | 1.25 | 1.3 |
| Comparative Example | 4.27 | 6.65 | 10.37 |
| Example 1 | 2.94 | 3.94 | 5.27 |
| Example 2 | 3.09 | 4.24 | 5.83 |
| Example 3 | 2.66 | 3.53 | 4.68 |

Table 2 shows the resistance values measured when the samples were stretched at various stretching rates. The resistance values at various stretching rates of Table 2 were measured using an approximation formula obtained based on the relations between changes in the resistance values measured before and after stretching and the stretching rates. As seen from Table 2, the resistance values of Comparative Example measured when the sample was stretched at stretching rates of 1.25 times and 1.3 times were 6.65Ω and 10.37Ω, respectively. Meanwhile, the measured resistance values of Examples 1 to 3 were all still below 6Ω when the samples were stretched at a rate of 1.3 times. This proved that the wave-shaped conductive paste is more stretchable than the linear conductive paste and is capable of suppressing an increase in the resistance.

Although the embodiments of the present disclosure have been described in detail, the present disclosure is not limited thereto, and various design changes can be made without departing from the spirit and scope of the present disclosure described in the claims. For example, although sine and triangular wave-shaped defogger wires 13 have been described as examples in the aforementioned embodiments, the defogger wire 13 may also be in a rectangular, trapezoidal, or saw tooth wave shape.

DESCRIPTION OF SYMBOLS

1, 1A, 1B, 1C, 1D Resin window
11, 11A, 11B, 11C, 11D Resin glass
12 Film
13, 13A, 13B, 13C, 13D, 13E Defogger wire
14 Power supply unit
15 Black frame
21, 22 Conductive paste
23 Black paste
111, 112, 113, 115, 116, 121 Curved portion
114 Planar portion
131, 131A, 131B, 131C, 133, 134 Wave-shaped portion
132 Linear portion
211 Wave-shaped conductive paste
212 Linear conductive paste

What is claimed is:

1. A method for producing a resin window, comprising:
printing a conductive paste to form a defogger wire on a flat film;
stretching the film with the conductive paste printed thereon so as to form a curved portion; and
forming a resin glass integrated with the film with the curved portion formed thereon,
wherein in the printing, a wave-shaped conductive paste is printed on the film so as to extend in a direction in which the film is to be stretched in the stretching.

2. The method for producing the resin window according to claim 1, wherein the wave-shaped conductive paste is in a triangular wave shape.

3. The method for producing the resin window according to claim 1, wherein when a pair of curved portions are formed on opposite end sides of the film in the stretching, in the printing, the wave-shaped conductive paste is printed on the film at positions where the pair of curved portions are to be formed, and a linear conductive paste is printed on the film at another position.

4. The method for producing the resin window according to claim 3, wherein the wave-shaped conductive paste is attenuated gradually toward the linear conductive paste.

5. The method for producing the resin window according to claim 1, wherein in the printing, a plurality of conductive pastes are arranged in a direction orthogonal to a direction in which the film is to be stretched in the stretching, such that phases of the adjacent conductive pastes are shifted with respect to each other, and are then printed.

* * * * *